United States Patent [19]

Klemm

[11] Patent Number: 4,628,620

[45] Date of Patent: Dec. 16, 1986

[54] APPARATUS FOR CONTACT DRYING OR COOLING OF SHEETS AND THE LIKE

[76] Inventor: Gerhard Klemm, Am Rehwinkel 37, D-4800 Bielefeld 1, Fed. Rep. of Germany

[21] Appl. No.: 784,510

[22] Filed: Oct. 4, 1985

[30] Foreign Application Priority Data

Oct. 27, 1984 [DE] Fed. Rep. of Germany ..... 3439435
Feb. 25, 1985 [DE] Fed. Rep. of Germany ..... 3506520

[51] Int. Cl.[4] ..... F26B 19/00; F26B 3/34; F26B 5/04; F26B 13/30

[52] U.S. Cl. ..... 34/236; 34/1; 34/16; 34/92

[58] Field of Search ..... 34/1, 16, 92, 236

[56] References Cited

U.S. PATENT DOCUMENTS 2,319,031 5/1943 Baker ..... 34/92
2,948,966 8/1960 Hanson ..... 34/92
3,742,738 7/1973 Frotriede ..... 34/236

FOREIGN PATENT DOCUMENTS 565182 10/1972 U.S.S.R. ..... 34/1

*Primary Examiner*—John J. Camby
*Attorney, Agent, or Firm*—Peter K. Kontler

[57] ABSTRACT

Apparatus for contact drying or cooling of printed sheets in or adjacent to a screen printing machine has a rotor which is driven to rotate about a horizontal axis and carries a set of radially outwardly extending vane-like flat suction boxes each having a plate-like foraminous supporting member to which one or more objects to be dried and/or cooled are attracted by suction during travel of the respective box along a portion of one orbit or during one or more full orbits about the axis of the rotor. The suction boxes are connected to a source of compressed air when the objects on their supporting members reach the ejecting station. The rotor can carry a box-shaped nozzle with orifices oriented to direct jets of compressed air against the objects on the adjacent supporting members. Objects can be supplied by hand or by a conveyor and the treated objects gather in a receptacle or are deposited on a take-off conveyor.

49 Claims, 19 Drawing Figures

APPARATUS FOR CONTACT DRYING OR COOLING OF SHEETS AND THE LIKE

BACKGROUND OF THE INVENTION

The present invention relates to improvements in apparatus for heating, drying and/or cooling of relatively thin objects, such as freshly printed plates, webs or sheets of paper, synthetic plastic material, textile material and/or metal as well as numerous other objects including discrete components of electronic devices and the like.

German Pat. No. 26 07 504 discloses a drying apparatus with a series of stationary suction boxes or chambers which are disposed one after the other. A web or strip of material to be dried is transported at a level above the suction chambers. If the material to be treated includes a plurality of discrete objects, they are transported along successive suction chambers by a conveyor system. A drawback of the patented apparatus is that its space requirements are inordinately large as well as that it consumes substantial quantities of energy. The conveyor system includes a screen which is in rubbing contact with the stationary suction chambers so that such parts undergo pronounced wear with attendant high maintenance cost. Moreover, the prime mover which transports the screen must exert a pronounced pull in order to overcome friction between the conveyor system and the suction chambers.

German Offenlegungsschrift No. 31 03 421 discloses a rotary drying apparatus which includes a driven heated drum whose external surface is contacted by rather long and flat web-like objects issuing from a screen printing machine. The drum is not ideally suited for the drying and/or other treatment of discrete objects, such as small flexible sheets or plates. Furthermore, the drum cannot be used for uniform drying of rigid flat objects due to the pronounced curvature of its external surface. Moreover, the drying apparatus of the German publication is not equipped with any means for supplying discrete objects to and/or for accepting treated objects from the drum.

OBJECTS AND SUMMARY OF THE INVENTION

An object of the invention is to provide a novel and improved contact drying or cooling apparatus which is more versatile and whose energy requirements are much lower than those of conventional apparatus.

Another object of the invention is to provide a compact drying or cooling apparatus which can treat rigid or flexible objects with the same degree of reproducibility and predictability and which can be used for drying, heating, cooling and/or similar treatment of manually or automatically supplied objects.

A further object of the invention is to provide an apparatus wherein the means for supporting and transporting the objects during treatment need not rub against stationary parts so that the wear upon the stationary and moving parts of the apparatus is minimal.

An additional object of the invention is to provide a printing machine, particularly a screen printing machine, which embodies the above outlined apparatus.

Still another object of the invention is to provide an apparatus which is constructed and assembled in such a way that the objects can be readily delivered to and just as readily separated from their supporting members.

A further object of the invention is to provide the apparatus with novel and improved means for supporting the objects during treatment and with novel and improved means for influencing the temperature and/or other parameters of objects during treatment.

An additional object of the invention is to provide the apparatus with novel and improved means for simultaneously subjecting each object to several treatments such as pronounced heating or cooling as a result of direct contact with heated or cooled supports as well as pronounced heating or cooling by streams of a gaseous fluid.

A further object of the invention is to provide the apparatus with novel and improved means for urging each portion of each object against its support with a predictable force.

Another object of the invention is to provide a novel and improved method of contact drying or cooling discrete sheets, plates and like flat or flexible objects consisting of metal, plastic, paper, textile material or a combination of several substances.

The invention resides in an apparatus for contact drying and/or cooling sheet- or plate-like and other relatively thin objects. The apparatus comprises a rotor, drive means for the rotor, and a plurality of suction chambers or boxes provided on and extending outwardly from the rotor. Each suction chamber has a substantially plate-like foraminous object-supporting member. Each supporting member is provided with a plurality of openings or ports which attract the objects during orbital movement of the supporting members about the axis of the rotor.

The drive means is designed to rotate the rotor about a predetermined axis (preferably about a horizontal axis) and in a predetermined direction. Each supporting member is or can be located in a plane which is substantially parallel with or includes the axis of rotation of the rotor. Furthermore, each supporting member has an exposed object-contacting side which faces forwardly, as considered in the direction of rotation of the rotor. The drive means can comprise means for continuously or intermittently rotating the rotor about its axis.

The apparatus further comprises a suction generating device and means for connecting the suction chambers to the suction generating device during a predetermined portion of each revolution of the rotor. The suction chambers orbit about the axis of rotation of the rotor along an endless path, and each such suction chamber has an inlet-outlet which travels along a stationary valving element of the connecting means. The valving element has a preferably arcuate channel which is adjacent to at least one predetermined portion of the endless path and is connected with the suction generating device so that the inlets-outlets of the suction chambers communicate with the channel during travel of the respective suction chambers along the predetermined portion of the endless path. An object-supplying station is established adjacent to the predetermined portion of the path if it is desired that the objects which are supplied to consecutive suction chambers be attracted by suction as soon as they come into contact with the supporting members. The object supporting members are or can be at least substantially horizontal while the respective chambers are adjacent to the supplying station. This renders it possible to conveniently advance the objects onto the exposed sides of the oncoming supporting members.

The apparatus preferably further comprises means for accepting dried or cooled objects from the supporting members. Such accepting means is adjacent to a second predetermined portion of the path and each suction chamber which is located in such second portion of the path is preferably disconnected from the suction generating device in order to allow for ready separation of objects from the respective supporting members. The accepting means can comprise one or more receptacles for treated objects or one or more conveyors, for example, endless belt conveyors which transport freshly treated objects to storage or to a further processing station. The apparatus further comprises a source of compressed air and means for coupling the source with the suction chambers in the second predetermined portion of the endless path. The source can include the aforementioned suction generating device (or vice versa) and the coupling means can include a portion of the connecting means (or vice versa).

The rotor is preferably hollow, and each suction chamber preferably further comprises means for influencing the temperature of objects on the respective supporting member. Such apparatus then further comprises an energy source (such as a source of electrical energy) and means for connecting the energy source with the influencing means. The connecting means can include a portion (for example, a set of electrical conductors) in the interior of the hollow rotor. The influencing means can include a heating element, and each supporting member can include two panels. The heating elements are preferably sandwiched between the panels of the respective supporting members. One panel of each pair of panels has an exposed object-contacting side, and each suction chamber can be formed with a suction compartment which is adjacent to the other panel of the respective pair of panels. The supporting members have openings each of which extends from the exposed side of the respective one panel toward and communicates with the respective suction compartment. The connection between the energy source (particularly a source of electrical energy) and the heating element can comprise at least one carbon brush which is connected to the source of energy, at least one slip ring which is mounted on the rotor and contacts the carbon brush, and conductor means connecting the slip ring or slip rings with the heating elements in the suction chambers. As mentioned above, a portion of the conductor means can extend through the interior of the rotor, and such conductor means preferably further comprises terminals which are provided on or in the suction chambers at the exterior of the rotor.

The apparatus preferably further comprises bearing means which defines for the rotor a substantially horizontal axis. The supporting members are preferably distributed in such a way that the suction chambers resemble the vanes of a paddle wheel or impeller.

The means for connecting the suction generating device with the inlets-outlets of the suction chambers can comprise a manifold which is rotatable with the rotor and communicates with the compartments of the suction chambers, and a stationary valving element which is formed with a channel communicating with the suction generating device and with the manifold so as to connect the compartments of the suction chambers with the suction generating device by way of the valving element during at least one predetermined portion of each revolution of the rotor. The means for connecting the source of compressed air with the compartments of successive suction chambers can be designed to establish such connection by way of the valving element and the manifold while the compartments are sealed from the suction generating device. The valving element is preferably further provided with a groove which communicates with the source of compressed air, and the manifold is preferably provided with at least one first port for each compartment which communicates with the channel during the predetermined portion of each revolution of the rotor, and with at least one second port for each compartment. The second ports communicate with the groove of the valving element during another predetermined portion of each revolution of the rotor. The channel and the groove preferably have arcuate shapes and their centers of curvature are preferably located on the axis of rotation of the rotor. The means for connecting the suction generating device with the compartments of the suction chambers preferably further comprises a disc-shaped friction clutch element which is interposed between the valving element and the manifold and has apertures in register with the ports of the manifold. The clutch element is designed to rotate with the manifold and to rub against the adjacent side of the valving element. The connecting means between the suction generating device and the compartments of the suction chambers further comprises at least one conduit (e.g., a flexible hose) which connects the suction generating device with the channel of the valving element, and at least one additional conduit which connects the source of compressed air with the groove of the valving element. The conduit or conduits are preferably flexible. Means (such as a set of coil springs which bear against the valving element and react against a stationary but preferably adjustable retainer) is preferably provided to urge the valving element toward the manifold. The aforementioned friction clutch element is held in continuous sealing contact with the stationary valving element under the action of such springs.

The apparatus preferably further comprises means for supplying objects to the supporting members of successive suction chambers in a predetermined portion of the endless path of orbital movement of suction chambers about the axis of the rotor. Brackets, profiled irons or similar coupling means can be provided to releasably or permanently secure the suction chambers to the rotor. The suction chambers can be provided with suitably configurated ledges or other means for properly locating objects on the respective supporting members during treatment in the improved contact drying or cooling apparatus.

If the apparatus is designed to dry and/or cool objects having predetermined outlines (for example, objects having undulate shapes), the supporting members are preferably provided with profiles which are complementary to the outlines of the objects.

An object-supplying station can be established adjacent to a predetermined portion of the path, and an emergency actuating device (such as a pivotable lever) can be mounted adjacent to or at the supplying station so as to be within reach of the hand of an attendant to control the operation of the drive means. Such drive means can include a prime mover (for example, a variable-speed electric motor) and a power train between the prime mover and the rotor. The power train can include one or more friction clutches, a suitable transmission and an endless chain or belt conveyor which connects the transmission with the rotor. The supporting members can receive objects directly from the printing station of a screen printing machine.

The suction chambers can constitute substantially flat box-like structures, and each of the supporting members can be provided with an object-contacting screen. Means can be provided for individually tensioning the screens of the supporting members. Each such supporting member can further comprise an uneven back support for the respective screen. The uneven back support can be used to bulge selected portions of the screens so as to ensure a more predictable and larger-area contact between the screens and the objects on the corresponding supporting members.

The apparatus can further comprise means for blowing compressed air against the objects on the supporting members. Such blowing means can comprise nozzles which alternate with the suction chambers and have orifices which are designed to direct jets of compressed air or another gaseous fluid against the objects on the adjacent supporting members. The nozzles in the adjacent supporting members preferably define clearances or gaps for the placing of objects onto and for removal of objects from the respective supporting members. The source of compressed air is connected with the nozzles, for example by way of an arcuate channel in the valving element. The arcuate channel can be connected with the source of compressed air by means of one or more flexible conduits.

Discrete regulators can be provided on the suction chambers to allow for adjustment of the heating action of the aforementioned heating elements. Such heating elements are replaced by cooling elements if the apparatus is used for the cooling of objects. A housing can be provided to surround at least a portion of the endless path of orbital movement of the suction chambers about the axis of the rotor. Each suction chamber can extend at least substantially radially of and outwardly from the rotor.

The dimensions of the the nozzles preferably match or at least approximate the dimensions of the adjacent supporting members.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
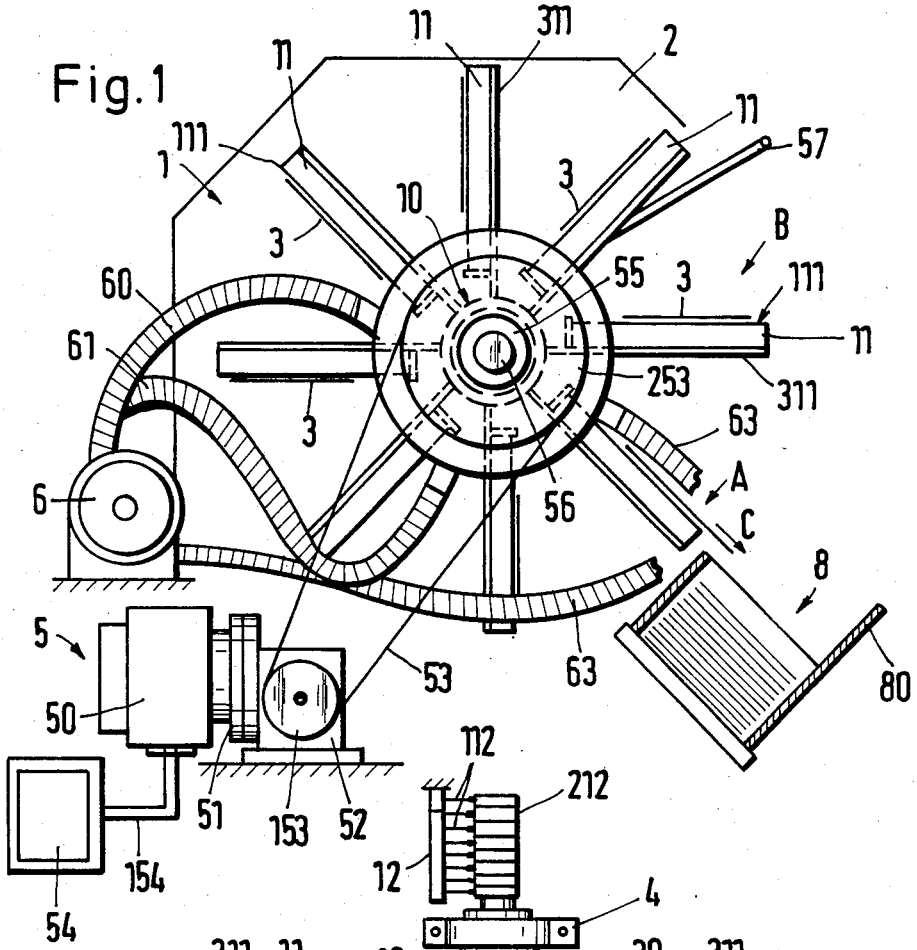
FIG. 1 is a schematic partly elevational and partly vertical sectional view of a contact drying or cooling apparatus which embodies one form of the invention.
Figure 2:
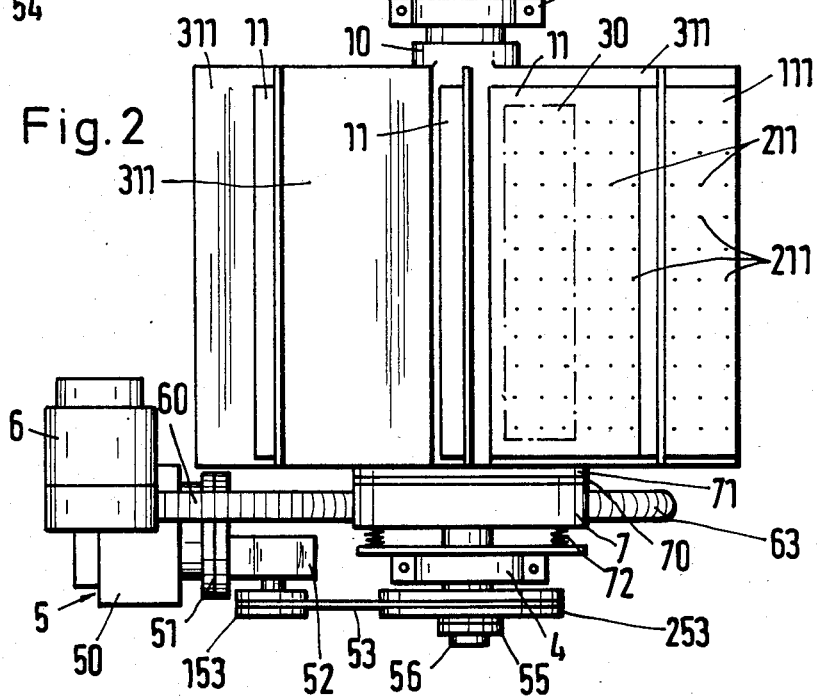
FIG. 2 is a plan view of the apparatus, with the housing omitted.

Referring first to FIGS. 1 and 2, there is shown a contact drying or cooling apparatus 1 having a hollow rotor 10 and a set of eight equidistant radially outwardly extending flat suction boxes or chambers 11 which orbit along an endless path surrounding the circumference of the rotor. The apparatus comprises a stationary housing 2 which partially surrounds the endless path of movement of the suction boxes or chambers (hereinafter called suction chambers) 11. The suction chambers 11 resemble the vanes of a paddle wheel and are located in planes which are parallel to or include the horizontal axis of rotation of the rotor 10. Each suction chamber 11 has, a substantially plate-like object-supporting member 111 which is located at its front side, as considered in the direction of rotation of the rotor 10. In FIG. 1, the rotor 10 rotates in a counterclockwise direction. The exposed sides of the supporting members 111 can attract discrete workpieces or objects 3 in the form of sheets, plates, foils, films or the like. The means for mounting the rotor 10 in the housing 2 comprises suitable bearings 4 which can be seen in FIG. 2 and define the aforementioned horizontal axis about which the suction chambers 11 orbit when the apparatus 1 is in actual use.

The apparatus 1 further comprises a drive 5 which serves to rotate the rotor 10 at a constant rate or intermittently, depending upon the nature of objects 3 and upon the nature of their treatment. The drive 5 comprises a prime mover 50 (such as a gear motor) which drives the input element of a transmission 52 through the medium of a clutch 51. The power train between the prime mover 50 and the shaft 56 of the rotor 10 further comprises an endless belt or chain conveyor 53 which is trained over a driver pulley or sprocket wheel 153 on the output element of the transmission 52 and a driven pulley or sprocket wheel 253 on the shaft 56. A control unit 54 is connected with the prime mover 50 by conductors 154. The control unit 54 can select the speed of the rotor 10 and/or the intervals of time during which the motor 50 is on. As mentioned above, the motor 50 can drive the rotor 10 continuously or at predetermined intervals with predetermined periods of dwell between successive intervals of rotary motion. It is also possible to employ a transmission which is capable of rotating the shaft 56 without interruptions or in stepwise fashion. The exact construction of the drive 5 forms no part of the present invention because the improved apparatus 1 can utilize any one of a wide variety of drives as long as the selected drive can rotate the shaft 56 at a required speed and for required intervals of time.

A friction clutch 55 is preferably interposed between the driven pulley or sprocket wheel 253 and the shaft 56 of the rotor 10 so as to ensure that the rotary member 253 cannot transmit excessive stresses. Thus, if the rotor 10 encounters excessive resistance to rotation, the friction clutch 55 enables the pulley or sprocket wheel 253 to rotate relative to the arrested shaft 56. The shaft 56 can constitute a stub one end portion of which is rotatably journalled in the housing 2 and the other end portion of which carries the friction clutch 55 and the driven pulley or sprocket wheel 253. The rotor 10 can be integrally or separably connected with the shaft 56.

The apparatus 1 of FIGS. 1 and 2 further comprises a combined suction generating device and source of compressed air 6 (hereinafter called fan) and means for connecting the fan 6 with the internal compartments 11A (see FIG. 6) of the suction chambers 11. The connecting means includes a stationary ring-shaped valving element 7 which is inwardly adjacent to the pulley or sprocket wheel 253 and is in sealing engagement with one side of a disc-shaped friction clutch element 70 which rotates with a rotary ring-shaped manifold 71 that is mounted on and shares the angular movements of the rotor 10. The valving element 7 is connected with the suction intake of the fan 6 by two flexible conduits or hoses 60 and 61 and has an arcuate channel 74 (see particularly FIG. 4) which constitutes a little less than a complete annulus and communicates with the intake of the fan 6 by way of two nipples 161, 162 which are connected to the corresponding ends of the hoses 60 and 61. The clutch element 70 has pairs of apertures 170 (see particularly FIG. 3), one pair for each suction chamber 11, and one aperture 170 of each pair communicates with the channel 74 during travel of the corresponding pair of apertures 170 along the channeled portion of the valving element 7. The manifold 71 has pairs of ports or openings **113*a*, 113*b* (see FIG. 12) which are in register with the adjacent pairs of apertures 170 in the clutch element 70. As mentioned above, the clutch element 70 and the manifold 71 rotate relative to the stationary valving element 7**.

Figure 4:
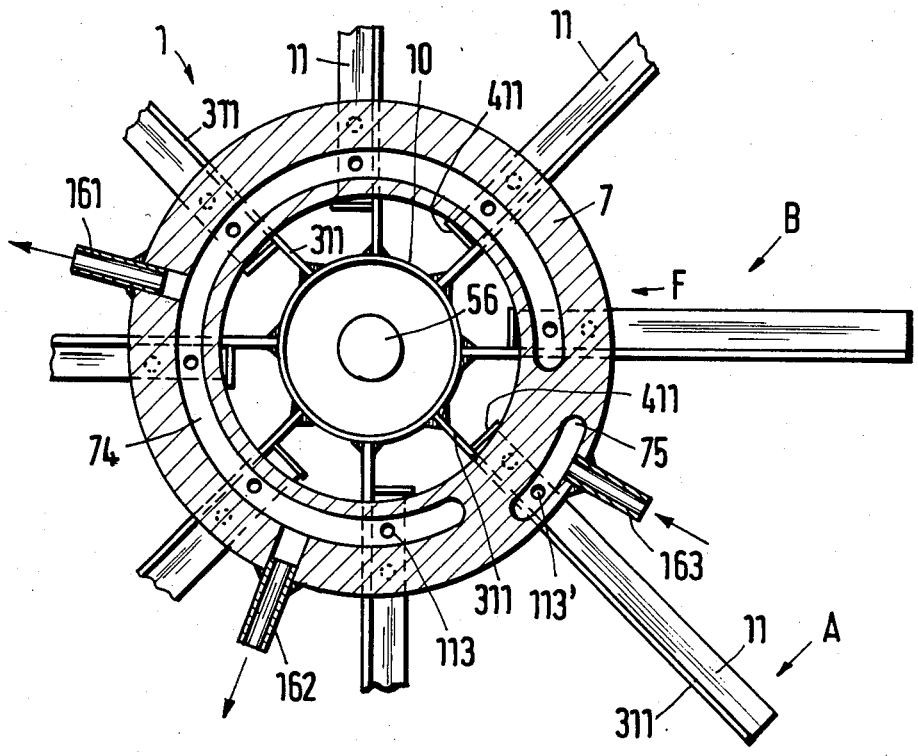
FIG. 4 is an enlarged fragmentary vertical sectional view as seen in the direction of arrows from the line IV—IV of FIG. 3.
Figure 3:
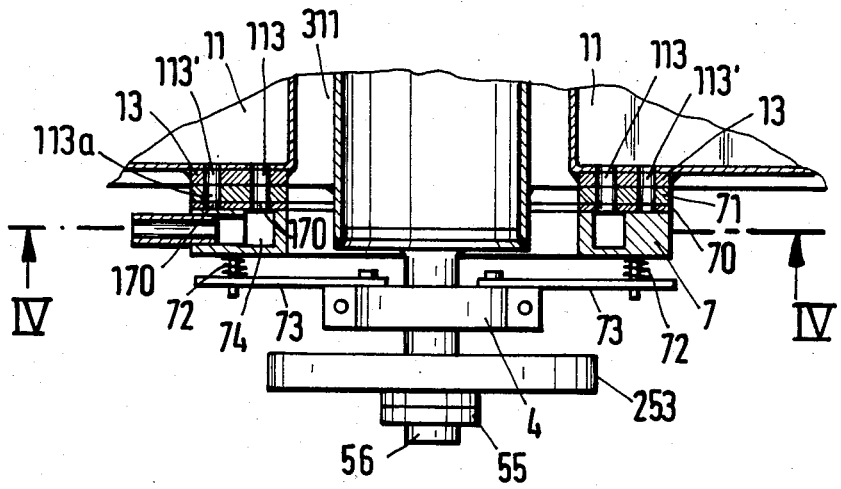
FIG. 3 is a fragmentary horizontal sectional view of the apparatus.

The rotor 10 is a hollow cylindrical body and is permanently or separably coupled with the suction chambers 11 by means of webs or ribs 311. FIG. 4 shows that the webs 311 are welded to the rotor 10, and FIG. 3 shows that each suction chamber 11 has a combined plate-like inlet and outlet 13 which is adjacent to the manifold 71 and has two ports 113, 113'. Each port 113 is in register with a port **113*b* of the manifold 71 and each port 113' is in register with a port 113*a* of the manifold 71. When a compartment 11A is to be connected to the suction intake of the fan 6, such connection is established by way of the corresponding port 113 in the respective inlet-outlet 13, by way of the corresponding opening of port 113*b* in the manifold 71, by way of the corresponding aperture 170 in the clutch element 7, by way of the channel 74 in the stationary valving element 7, and by way of the hoses 60, 61. Each plate-like inlet-outlet 13 is adjacent to the exterior of the rotor 10 at that end of the shaft 56 which carries the manifold 71**.

The valving element 7 is further formed with an arcuate second channel 75 (hereinafter called groove in order to distinguish from the channel 74) whose curvature is the same as that of the channel 74. The centers of curvature of the channel 74 and groove 75 are located on the axis of the shaft 56 for the rotor 10. The distance between the axis of the shaft 56 and the channel 74 is less than the distance between the axis of the shaft 56 and the groove 75. The groove 75 registers with successive ports 113' when the rotor 10 is in motion and this groove is connected with the compressed air outlet of the fan 6 by a further flexible conduit or hose 63 and a nipple 163. Thus, if a compartment 11A is to communicate with the pressure outlet of the fan 6, such communication is established by connecting means including the port 113' in the corresponding plate-like inlet-outlet 13, by way of the corresponding opening **113*a* in the manifold 71, by way of the corresponding aperture 170 in the clutch element 70, by way of the groove 75 in the valving element 7, and by way of the nipple 163 and hose 63**.

The object-accepting receptacle 8 of FIG. 1 is located at the ejecting or discharging station A and is provided with a plate-like stop 80 which prevents further longitudinal movement of treated objects 3 in the direction of the arrow C. Such objects are expelled or permitted to descend by gravity from the supporting member 111 of the suction chamber 11 which arrives at the ejecting or discharging station A. In the apparatus 1 of FIG. 1, the exposed side of the supporting member 111 at the station A slopes downwardly at an angle of approximately 45 degrees to the horizontal so as to allow for predictable and reliable expulsion or evacuation of treated objects 3 into the accepting receptacle 8. The position of the groove 75 in the stationary valving element 7 is selected in such a way that the compartment 11A of the suction chamber 11 at the station A is connected with the pressure outlet of the fan 6 so as to ensure that streamlets of compressed air which flow outwardly through the foraminous supporting member 111 at the station A can promote predictable expulsion of the treated object 3 into the receptacle 8. FIG. 4 shows that the channel 74 begins slightly downstream of the station A and slightly upstream of an object supplying station B. However, it is equally possible to provide the valving element 7 with a circumferentially complete channel 74 or to shorten the channel 74 so that it begins only at the level of the arrow F in FIG. 4, namely slightly above the level of the object supplying station B. At this station, the apparatus can receive successive objects 3 from a conveyor, or such objects can be deposited on the top sides or exposed sides of the supporting members 111 by hand. For example, the apparatus 1 can be installed in or adjacent to a screen printing machine, and freshly treated objects in the form of sheets or plates can be transferred from the screen printing machine, or from the printing station of the screen printing machine, directly onto successive supporting members 111 while the rotor 10 is driven, either continuously or intermittently, in a counterclockwise direction as viewed in FIG. 1 or 4. The channel 74 preferably begins at the object supplying station B (as shown in FIG. 4 by solid lines) if the objects 3 are delivered by hand. The reference character 211 denotes in FIG. 5 the holes, ports or openings which are provided in the supporting members 111 of the suction chambers 11 to establish communication between the outer sides of the supporting members 111 and the respective compartments 11A. Such holes 211 draw air into the respective compartments 11A when the compartments are connected to the suction intake of the fan 6, and the holes 211 discharge streamlets of compressed air when the corresponding compartments 11A communicate with the groove 75 of the stationary valving element 7. If the objects 3 to be treated are smaller than the exposed sides of the supporting members 111, the non-utilized portions of the exposed sides of the supporting members 111 are preferably covered by masking tape 30 (see FIG. 2) so as to seal the corresponding holes 211. This ensures more predictable retention of objects 3 on the exposed sides of the supporting members 111 irrespective of the exact shape and/or size of the objects. Instead of masking tape, the apparatus can also employ rigid shrouds or baffles which are placed over the non-utilized portions of the supporting members 111 if the dimensions of the objects 3 are smaller than those of the suction chambers 11.

FIG. 1 shows a lever 57 which constitutes an emergency actuating means for the drive 5. For example, the lever 57 can be operatively connected with the control unit 54 so as to enable an operator to arrest the prime mover 5 or to disengage the clutch 51 if the object 3 at the object supplying station B is not properly oriented relative to the corresponding suction chamber 11 or if the hand or hands of the operator are in danger as a result of continued rotation of the rotor 10. The exact nature of the operative connection between the lever 57 and the control unit 54 forms no part of the present invention. Such connection can include a suitable switch which can be closed by the lever 57 and whose closing entails a disengagement of the friction clutch 51 in the power train between the prime mover 50 and the shaft 56 for the rotor 10. The friction clutch element 70 cooperates with the stationary valving element 7 to constitute a second friction clutch which is interposed between the valving element 7 and the manifold 71. It is clear that the lever 57 can also be used to disengage the friction clutch 55 in addition to or in lieu of the clutch 51.

Figure 5:
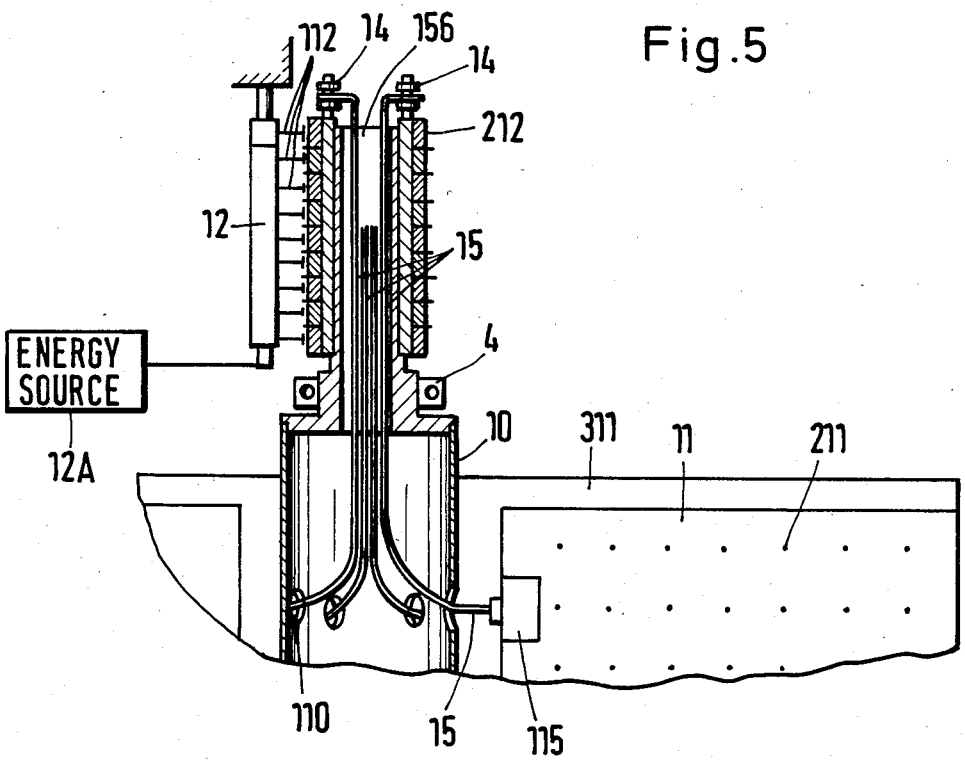
FIG. 5 is another fragmentary horizontal sectional view of the apparatus, showing the manner of connecting the temperature influencing elements of the suction chambers to an energy source.

As shown in FIGS. 2 and 5, the means for influencing the temperature of objects 3 on the supporting members 111 can be connected with an external energy source 12A by a system a portion of which extends through the interior of the hollow rotor 10. The influencing means can include heating elements or pads (see the pad **111*a* in FIGS. 6 and 8), and the connection between the energy source 12A and such heating elements can comprise a conductor 12 which is adjacent to one end portion 156 of the shaft 56 for the rotor 10, several carbon brushes 112 which are connected to the conductor 12, a corresponding number of slip rings 212 on the end portion 156, terminals 14 on the end portion 156, and conductors 15 which extend from the terminals 14 to terminals 115 on the corresponding suction chambers 11. Portions of the conductors 15 extend through holes 110 which are provided in the main body portion of the rotor 10**.

FIGS. 2 and 3 show a set of coil springs 72 which serve to bias the axially movable valving element 7 against the clutch element 70. The springs 72 react against a stationary back support or retainer 73 which is attached to the corresponding bearing 4. The position of the retainer 73 (as considered in the axial direction of the rotor 10) can be changed to thereby change the force with which the valving element 7 is urged against the adjacent side of the clutch element 70. The coil springs 72 prevent escape of air between the parts 7 and 70.

The webs or ribs 311 which couple the suction chambers 11 to the rotor 10 are provided with ledges 411 which constitute locating means or stops for the objects 3 and ensure that each object is properly positioned with reference to the exposed side of the corresponding supporting member 111. Each of the suction chambers 11 resembles a flat box of at least substantially constant thickness. The dimensions of the suction chambers 11 can equal or slightly exceed the dimensions of the largest objects 3 which are to be treated in the apparatus of FIGS. 1 to 5.

Referring again to FIG. 4, it will be seen that two relatively narrow portions of the valving element 7 (as considered in the circumferential direction of the rotor 10) are disposed between the end portions of the channel 74 and the corresponding end portions of the relatively short arcuate groove 75. Such non-grooved and non-channeled portions of the valving element 7 ensure that the objects 3 on the supporting members 11 travelling from one end of the channel 74 toward the corresponding end of the groove 75 are not attracted by suction and that the holes 211 of the supporting members 111 advancing from the upper end of the groove 75 toward the object supplying station B do not discharge streamlets of compressed air on their way toward the location where they receive untreated objects. However, and as mentioned above, the illustrated channel 74 can be replaced with a circumferentially complete channel, especially if the objects 3 are to be deposited and/or withdrawn by hand.

Figure 9:
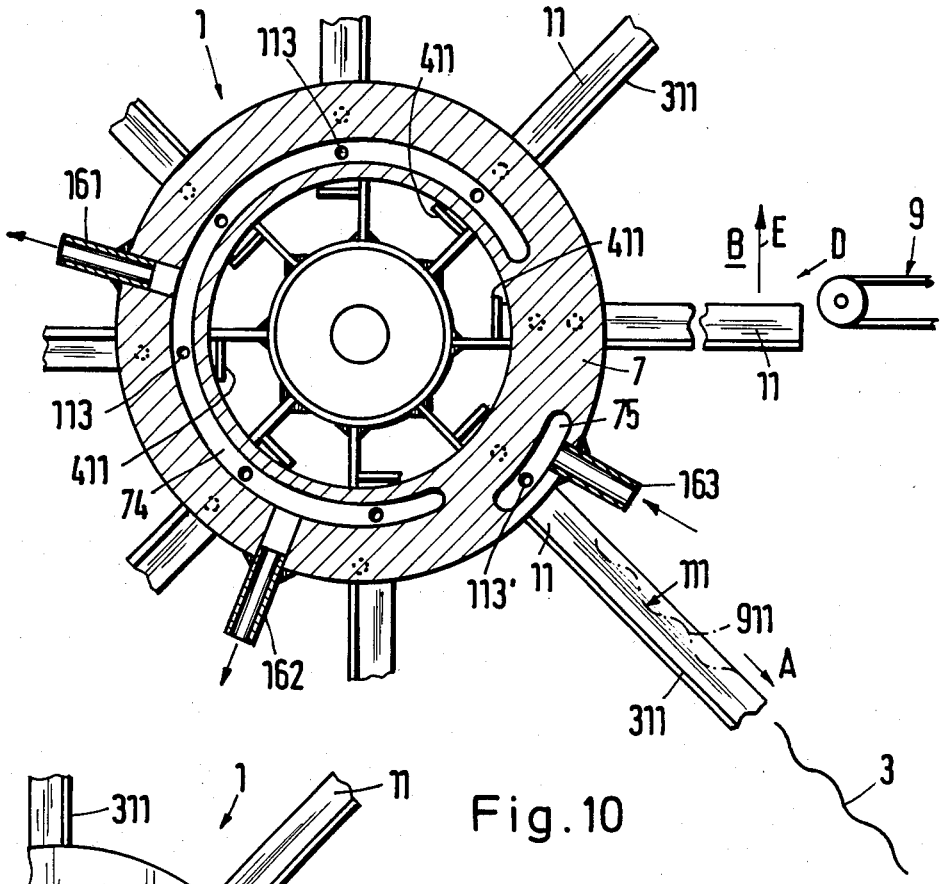
FIG. 9 is a fragmentary vertical sectional view of a second apparatus which is designed to treat uneven objects and wherein the objects to be treated are supplied by a conveyor.

The channel 74 is preferably shortened (so as to begin at the level of the arrow F in FIG. 4) if the objects 3 are supplied by an automatic or semiautomatic filling mechanism, for example by a conveyor such as the conveyor 9 which is shown in FIG. 9 and serves to deliver untreated objects in the direction of the arrow D.

If the objects 3 on the supporting members 111 require cooling rather than heating, the heating elements **111*a* are replaced with suitable cooling elements and the means for cooling can receive energy from the source 12A substantially in the same way as shown in FIG. 5. It is also possible to provide a single electrically operated cooling unit which is installed in the interior of the hollow rotor 10 and receives energy in a manner as shown in FIG. 5. Such cooling unit is connected with discrete cooling elements in the suction chambers 11 by conduits and/or conductors which replace the conductors 15 of FIG. 5. The terminals 115 allow for ready separation of heating elements 111*a* (or of cooling elements) from the corresponding conductors 15**. The exact nature of the connections between the conductors 15 and the corresponding terminals 115 forms no part of the present invention.

Figure 6:
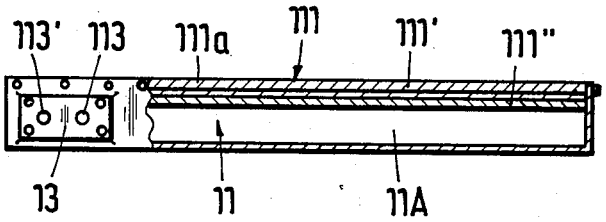
FIG. 6 is a fragmentary partly side elevational and partly sectional view of a suction chamber.
Figure 7:
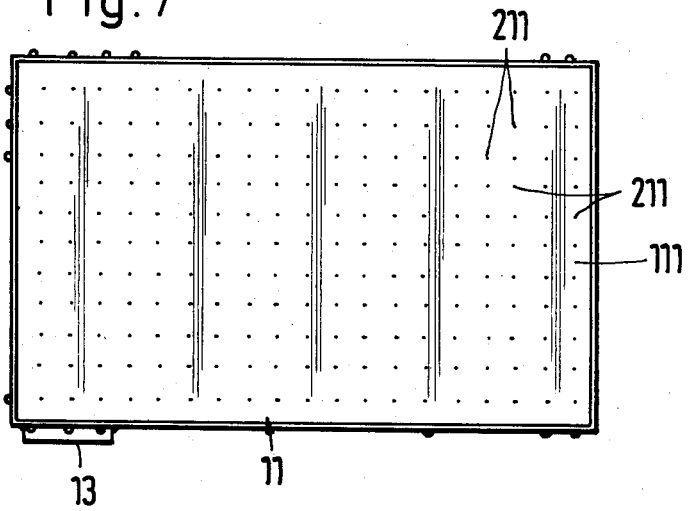
FIG. 7 is a front elevational view of a suction chamber.
Figure 8:
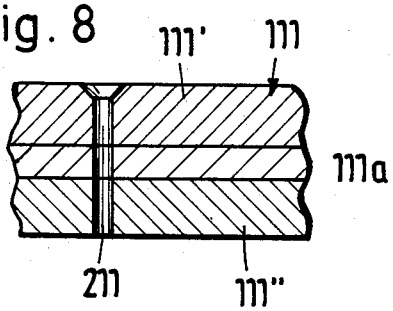
FIG. 8 is an enlarged fragmentary sectional view of the supporting member in a suction chamber.

FIGS. 6 to 8 illustrate the construction of one presently preferred embodiment of a suction chamber 11 which can be utilized in the apparatus 1 of FIGS. 1 to 5. The compartment 11A is adjacent to the inner side of a sandwich including two flat panels 111', 111" which flank the heating element 111*a*. The panels 111', 111*a* allow for reliable sandwiching of the heating element 111 therebetween and constitute component parts of the corresponding supporting member 111. The holes, openings or ports 211 in the supporting member 111 extend all the way from the inner side of the panel 111" to the exposed object-contacting outer side of the panel 111'. This can be readily seen in FIG. 8. The distribution of holes 211 in the supporting members 111 can be seen in FIG. 7. The plate-like inlet-outlet 13 of the suction chamber 11 has the aforementioned compressed air port 113' and the corresponding suction port 113. As described above, the ports 113 of each inlet-outlet 13 can communicate with the channel 74 and the ports 113' can communicate with the groove 75 of the stationary valving element 7. The holes 211 have been omitted in FIG. 6 for the sake of clarity. FIG. 8 shows that the outer end portion of each hole 211 can be enlarged so as to resemble a conical frustum in order to ensure an even more predictable attraction of objects 3 to the exposed side of the outer panel 111'.

Figure 10:
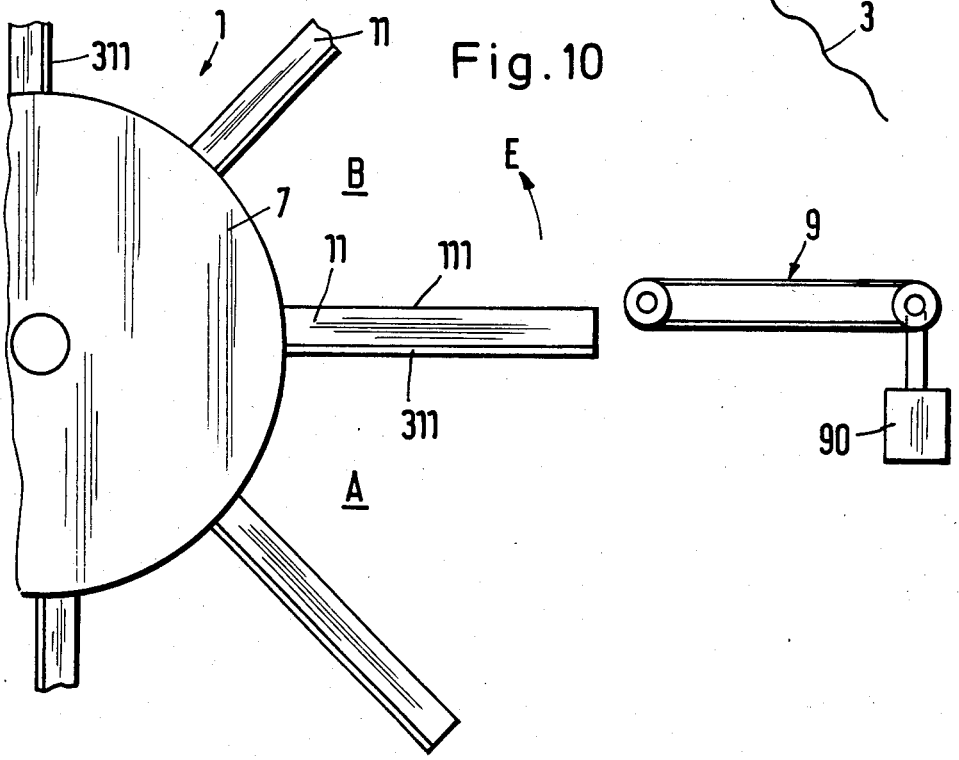
FIG. 10 is a fragmentary elevational view of the apparatus which is shown in FIG. 9.

Referring to FIGS. 9 and 10, the conveyor 9 can constitute an element of automatic or semiautomatic work supplying means which delivers sheets or analogous objects 3 from the screen printing station to successive supporting members 111 at the object supplying station B. The conveyor 9 can be driven by a prime mover 90 (see FIG. 10) which is preferably adjustable so as to ensure that the objects 3 are delivered at a rate corresponding to the rotational speed or the frequency of intermittent angular movements of the rotor 10 in the direction of the arrow E. The endless belt conveyor 9 of FIGS. 9 and 10 can be replaced with a vibratory conveyor or with any other suitable transporting means for sheet- or plate-like objects.

The improved apparatus is also capable of adequately supporting and of ensuring rapid drying or cooling of objects 3 having an undulate or other non-planar shape (see the lower right-hand portion of FIG. 9 which illustrates an undulate object 3). If the objects 3 of FIG. 9 are to be maintained in full surface-to-surface contact with the exposed sides of the corresponding supporting members 111, the supporting members 111 are preferably provided with profiles which are complementary to the outlines of the objects 3. This is indicated in FIG. 9 by a phantom line 911 on the supporting member 111 of the suction chamber 11 at the station A.

If desired, the object supplying station B can be located at the one-thirty o'clock position of FIG. 9. This ensures that the objects 3 which are supplied by the conveyor 9 in the direction of the arrow D descend by gravity toward the axis of the rotor 10 and invariably advance all the way to the corresponding ledges 411 in order to assume optimum positions with reference to the corresponding supporting members 111. If the station B is shifted in a counterclockwise direction, as viewed in FIG. 9, the dimensions of the channel 74 can be changed accordingly so as to prevent premature attraction of a freshly supplied object 3 before it reaches the corresponding ledge 411. The conveyor 9 can be caused to actually propel successive objects 3 onto the oncoming supporting members 111. The speed of the prime mover 90 is preferably variable so as to ensure that it can enable the conveyor 9 to propel flat or undulate objects 3 toward and into actual contact with successive ledges 411.

Figure 13:
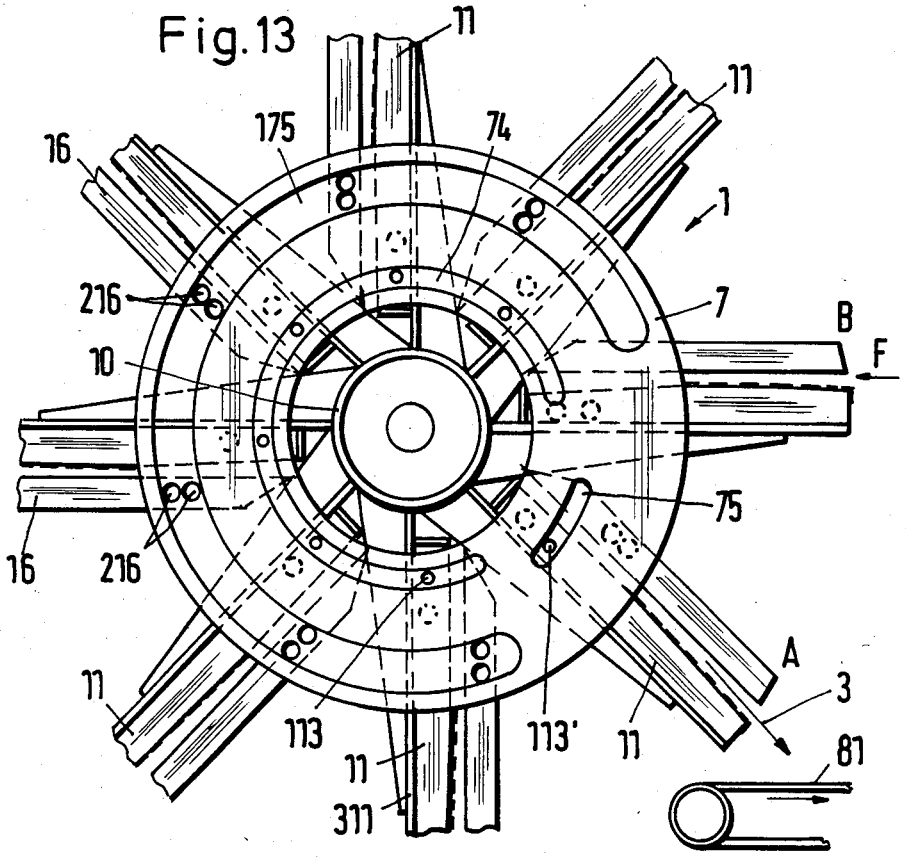
FIG. 13 is an enlarged fragmentary view of the third apparatus as seen in the direction of arrows from the line XIII—XIII of FIG. 12.

If the objects 3 are undulate or have other shapes which deviate from those of flat sheets or plates, the provision of the groove 75 is highly desirable and advantageous because the jets or streams of compressed air which issue from the holes 211 of the supporting members 111 promote predictable separation of treated objects 3 from such supporting members and the entry of treated objects into a collecting receptacle (such as the receptacle 8 of FIG. 1) or onto a suitable take-off conveyor (such as the conveyor 81 which is shown in FIG. 13).

If the direction of rotation of the rotor 10 is reversed, the suction chambers 11 can be turned through 180 degrees so that their supporting members 111 face forwardly, as considered in the direction of rotation of the rotor.

It is equally within the purview of the invention to design the apparatus for longer-lasting treatment of objects 3. For example, the arrangement may be such that each object rotates with the rotor 10 through an angle of 360 degrees or more and that an object is ejected or otherwise separated from the corresponding supporting member 111 only after it has completed more than one full revolution. This merely necessitates appropriate timing of the admission of compressed air into the groove 75 and proper timing of delivery of successive untreated objects 3 onto the supporting members 111 which arrive at the supplying station B. Furthermore, the supporting members 111 can be charged by hand all the way around the rotor 10 while the apparatus is at a standstill, and the rotor is thereupon caused to complete one or more revolutions at a desired speed so as to ensure adequate treatment (drying, cooling or heating) of the objects 3 before it is brought to a halt and the treated objects are removed by hand or in another way. The versatility of the improved apparatus renders it possible to treat a variety of different objects and to subject such objects to any one of a variety of different treatments.

Contact drying is desirable and advantageous in connection with the treatment of a number of objects, such as sheets, panels or plates which are coated with paint or with another liquid-containing substance in a screen printing or like machine. Contact drying reduces the likelihood of the development of a skin on the moisturized portions of sheets. Furthermore, solvents which are present in paints, lacquers or the like can readily evaporate in a contact printing apparatus, especially if the objects are in motion. The feature that the supporting members 111 are driven ensures a reduction of gas pressure. Drying with air is desirable in many instances, for example if it is necessary to withdraw heat, because the surrounding atmospheric air removes heat from the exposed side of the object 3 on a supporting member 111 while the other side of the object is relieved of heat as a result of direct contact with the supporting member.

Another important advantage of the improved apparatus is that its energy requirements are low irrespective of whether the apparatus is used for heating or cooling. This will be readily appreciated by considering the preceding description of the connections between the energy source 12A and the temperature influencing elements 111*a* in the suction chambers 11. The treatment can be completed within short intervals of time due to pronounced surface-to-surface contact between the objects 3 and the adjacent supporting members 111.

FIGS. 11 to 19 illustrate a further embodiment of the improved contact drying or cooling apparatus. The main difference between the apparatus of FIGS. 11 to 19 and the previously described apparatus is that the apparatus of FIGS. 11 to 19 comprises a set of flat plate-like or box-like blowing nozzles 16 which orbit about the axis of the rotor 10 and alternate with the suction chambers 11. Furthermore, each suction chamber 11 in the apparatus 1 of FIGS. 11 to 19 includes an object-supporting member 111 which includes a screen 511 (see particularly FIGS. 14, 15 and 16). Such supporting members are desirable when the objects 3 should not be placed into full surface-to-surface contact with the exposed sides of plates or like supports. The orifices 116 of the nozzles 16 face the adjacent supporting members 111 and discharge streamlets of compressed air or streamlets of another suitable gas so that the objects 3 on the supporting members 111 are treated in a number of ways including direct exchange of heat with the suction chambers 11, the influence of air in the corresponding ports 211 and the influence of streamlets of compressed gaseous fluid which are discharged by the corresponding orifices 116.

Figure 11:
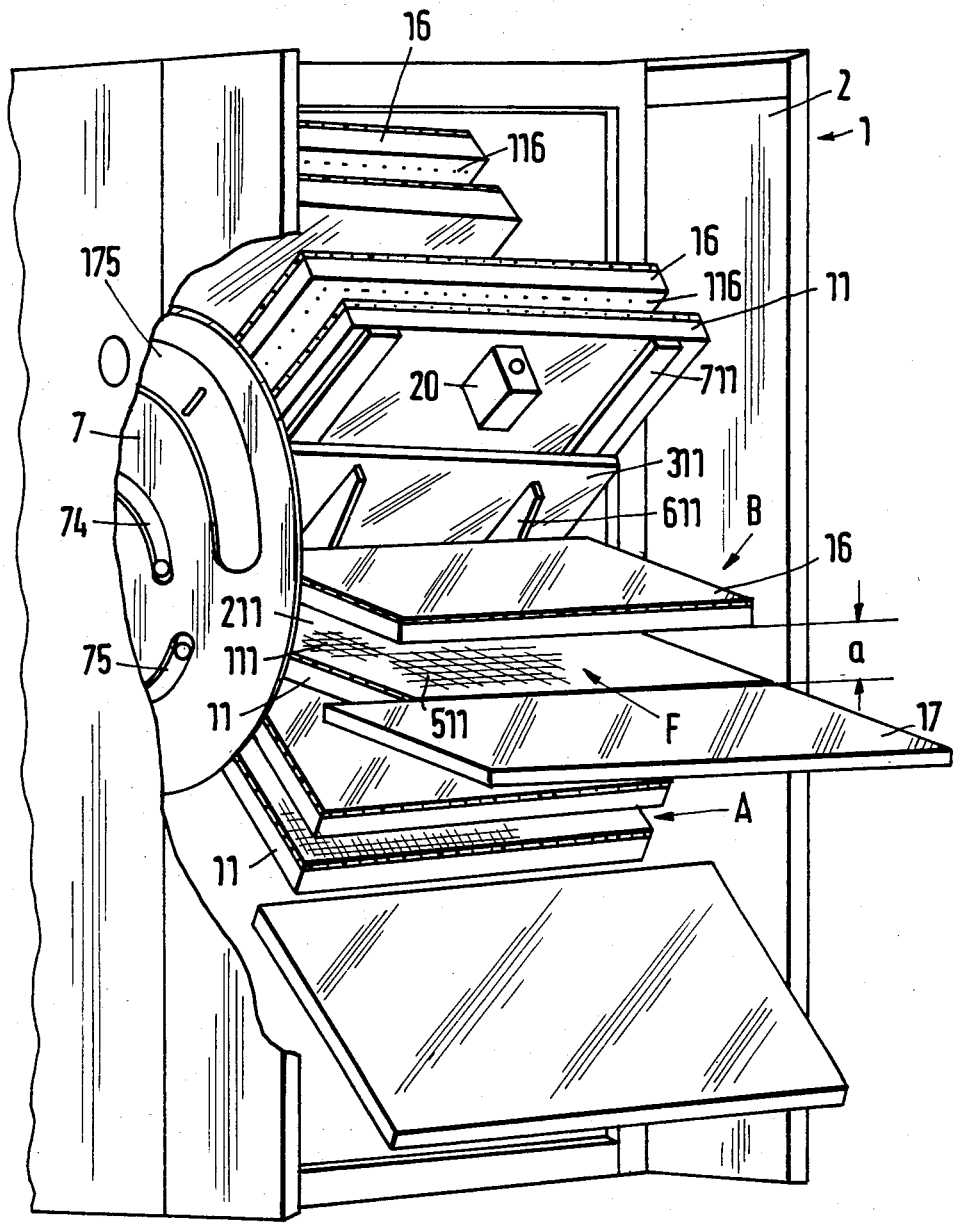
FIG. 11 is a fragmentary perspective view of a third apparatus wherein the rotor carries a discrete plate-like blowing nozzle for each suction chamber.

As can be seen in FIG. 11, the supporting members 111 of the suction chambers 11 define with the adjacent nozzles 16 relatively narrow clearances or gaps F for convenient and predictable admission of objects 3 onto the exposed sides of the oncoming screens 511 and for convenient withdrawal of treated objects at the station A. The object supplying station B is provided with a table or platform 17 which allows for predictable positioning of objects 3 prior to their introduction into the adjacent clearances F. The rotor 10 of the apparatus which is shown in FIGS. 11 to 19 can be operated intermittently if the objects 3 are placed onto the screens 511 by hand. The reference character a denotes the height or width of a clearance F.

The suction chambers 11 of the apparatus which is shown in FIGS. 11 to 19 can be provided with modified supporting members 111 which need not include screens 511. Such screens can be replaced by panels which consist of a foraminous material, by panels having a large number of holes or by panels which constitute lattices or like configurations in order to reduce the total area of contact with the adjacent objects. The foraminous material can be a synthetic plastic substance (for example, a rigid open-cell foam), a ceramic substance or the like. The provision of screens 511 or foraminous plate-like supporting members ensures more uniform application of suction to the entire side of an object which is placed onto the screen or onto a foraminous supporting member. The provision of a fine-mesh screen 511 or the provision of a foraminous plate-like supporting member 111 is desirable and advantageous if the objects constitute sheets or foils of highly flexible and readily deformable material so that the making of discrete holes of the type shown at 211 in FIG. 8 would entail pronounced deformation of adjacent portions of the foil by causing such portions to penetrate into the adjacent ends of the holes 211. This would result in the development of small protuberances at that side of each object 3 which overlies the adjacent supporting member 111. The screens 511 are immediately or closely adjacent to the adjacent panels of the corresponding supporting members 111. This ensures uniform distribution of suction which is applied by way of ports in the panel beneath the screen. In other words, the material of the screen 511 breaks up the streamlets of air which flow into the holes of a panel forming part of the supporting member 111 so that such streams are divided into a large number of smaller streams which are incapable of causing pronounced deformation of an object on the screen. Moreover, such breaking up of streams of air flowing into the holes of the panel ensures more uniform distribution of suction along the entire surface of an object on the screen 511. The distribution of suction is uniform regardless of the size of the object. It has been found that the utilization of screens 511 obviates the need for the masking tape 30 or for rigid masks as a means for covering those portions of the supporting members which are not overlapped by plate- or sheet-like objects.

As can be seen in FIG. 13, the dimensions of each nozzle 16 can match or approximate the dimensions of the adjacent suction chamber 11. The dimensions of all suction chambers 11 may but need not be identical, and the same applies for the nozzles 16. The width of the clearances F can be uniform all the way from the radially outermost to the radially innermost portions of the corresponding suction chambers 11, or the width of such clearances can increase or decrease in a direction toward the axis of the rotor 10. Each suction chamber 11 and the adjacent nozzle 16 can be said to define a "mouthpiece" or "mouth" for reception and retention of objects 3 during treatment in the apparatus 1. The screens 511 can be flat, or each such screen can be slightly or even substantially curved so as to exhibit a convex, a partially flat and partially convex, or a partially flat and partially concave exposed side which comes into actual contact with an object. For example, each screen 511 can have a radially outermost portion which has a convex outer side and a radially extending portion which has a flat outer side.

The apparatus of FIGS. 11 to 19 exhibits the important advantage that the objects are treated more rapidly and also that the objects are even more reliably held in optimum positions on the respective screens 511. This is attributable to the action of the nozzles 16 whose orifices 116 discharge streamlets of compressed air or another gas against the exposed sides of the objects 3 on the screens 511 so that the objects are attracted by suction and are simultaneously held on the screens by cushions of compressed air which are formed by the streamlets issuing from the respective orifices 116. The streamlets of air which issue from the orifices 116 can rapidly remove solvents which are present in paints, lacquers or other substances at the exposed sides of objects on the screens 511. The solvents can be caused to evaporate or are simply blown away. Such removal or expulsion of solvents takes place in addition to the solvent-removing action of air surrounding the orbiting suction chambers 11. In other words, those movements of air which are attributable to rotation of the rotor 10 are assisted by streamlets of air which issue from the orifices 116 to thus ensure very rapid and highly predictable and thorough expulsion of solvents or other substances which should be expelled from the exposed surfaces of the objects as well as from those surfaces which face the screens 511. The distribution of orifices 116 is preferably uniform (see particularly FIGS. 17 and 18) so as to even further enhance the predictability of the action of streamlets of compressed air or another gas upon the objects which are held on the screens 511. The streamlets of compressed air or another gas which issues from the orifices 116 reduce the pressure of solvents in the paints or lacquers which are applied to the objects 3, and this contributes to a substantial reduction of drying times.

FIG. 11 shows that the webs or ribs 311 for the suction chambers 11 have arms 611 which carry the adjacent nozzles 16. The rear or trailing sides of the suction chambers 11 are further provided with braces or strips 711 which extend radially of the rotor 10 and flank discrete regulators 20 for the heating elements of the corresponding supporting members 111. The clearances F are preferably located in planes which include the axis of the rotor 10 or the planes of such clearances are closely adjacent to the axis of the rotor, i.e., the clearances F preferably extend radially outwardly with reference to the external surface of the rotor.

Figure 12:
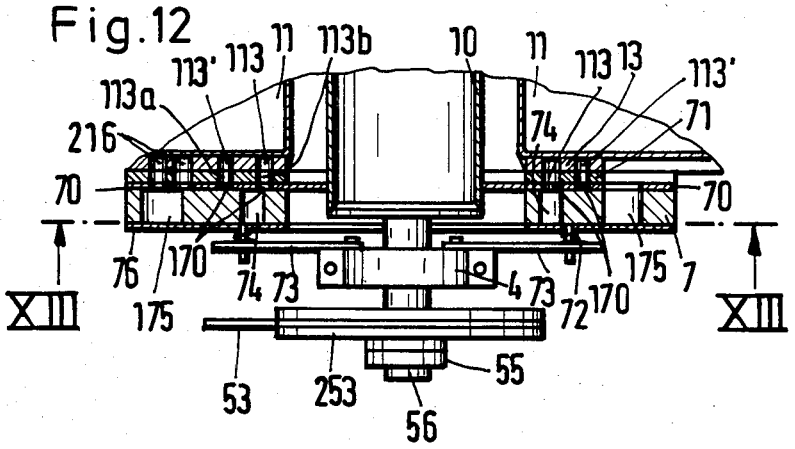
FIG. 12 is a fragmentary horizontal sectional view of the apparatus which is shown in FIG. 11.

FIGS. 12 and 13 show the presently preferred manner of connecting the compartments 11A of the suction chambers 11 and the compartments 16A of the nozzles 16 with the fan (not shown). The parts which correspond to those shown in FIGS. 3 and 4 are denoted by similar reference characters and are not described again. The valving element 7 is formed with an arcuate channel 175 which is connected with the pressure side of the fan, the same as the arcuate groove 75. The nozzles 16 have pairs of openings 216 which communicate with the channel 175 so that the compartments 16A communicate with the pressure side of the fan as long as the corresponding openings 216 are in communication with the channel 175. The position of the channel 175 is selected in such a way that the nozzles 16 are disconnected from the fan during travel along the object supplying station B and along the evacuating or ejecting station A. The, channel 175 is a slot which extends all the way through the valving element 7, as considered in the axial direction of the rotor 10. The outer or front side of the valving element 7 is overlapped by a plate-like cover 76. Such cover has been omitted in FIG. 13 so as to allow for clearer illustration of the channels 74, 175 and groove 75.

FIG. 13 shows the take-off conveyor 81 which receives treated objects 3 at the station A and delivers such objects to storage or to a further processing station, not shown. The clutch element 70 of FIG. 12 is provided with openings which register with the openings 216 of the flat box-shaped nozzles 16 so as to enable the openings 216 to communicate with the channel 175 during the major part of each revolution of the rotor 10.

Figure 14:
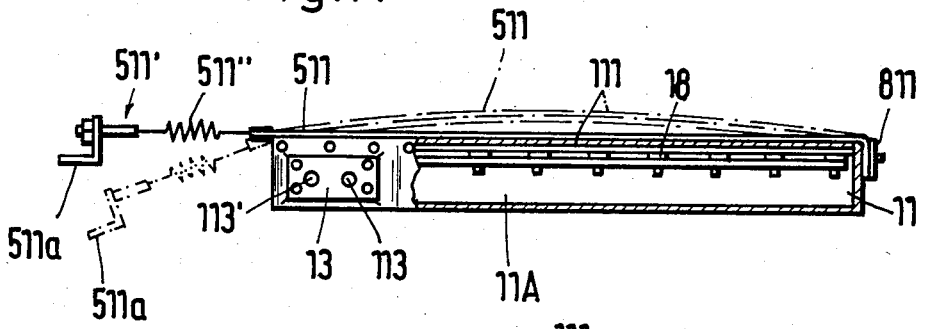
FIG. 14 is a partly elevational and partly sectional view of a modified suction chamber whose supporting member has an object-contacting screen.
Figure 15:
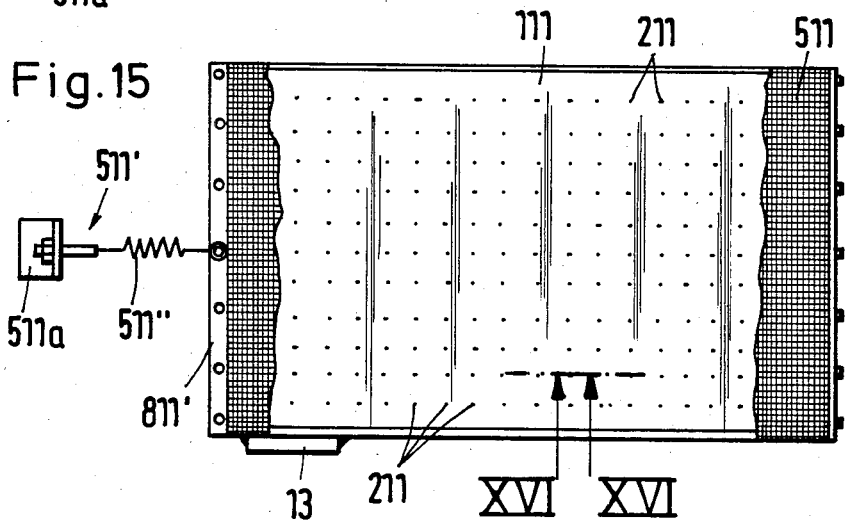
FIG. 15 is a front elevational view of the suction chamber which is shown in FIG. 14.
Figure 16:
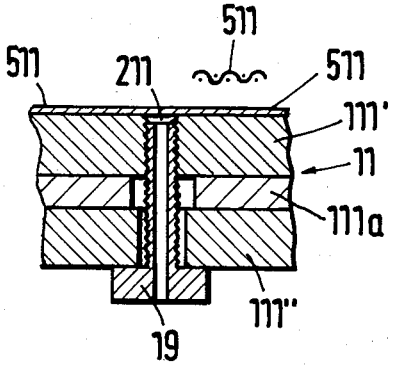
FIG. 16 is an enlarged fragmentary sectional view of the supporting member in the suction chamber of FIGS. 141-15 as seen in the direction of arrows from the line XVI—XVI of FIG. 15.

FIGS. 14 to 16 show the construction of a suction chamber 11 which is utilized in the apparatus of FIGS. 11 to 13. The reference character 18 denotes a cooling element which can be utilized in lieu of a heating element **111*a* and is installed in the interior of the suction chamber 11, i.e., in the corresponding compartment llA. The cooling element 18 is removable so that it can be replaced with a heating element if the apparatus is to be converted for the heating and drying rather than for the cooling of objects. The construction of the plate-like inlet-outlet 13 is the same as or analogous to that of the inlet-outlet shown in FIG. 6. The screen 511 is tensioned by a tensioning device 511' which includes a retainer 511*a* for one end of a coil spring 511" attached to the adjacent marginal portion of the screen 511. The other marginal portion of the screen 511 is attached to the main portion of the suction chamber 11 by a U-shaped clamping device 811. A similar U-shaped clamping device 811' connects the screen 511 with the coil spring 511". The supporting member 111 includes the screen 511 plus two plate-like panels which correspond to the panels 111', 111" of FIG. 6 and are formed with holes corresponding to the openings, ports or holes 211 shown in FIGS. 7 and 8. The position of the retainer 511*a* can be changed so as to impart to the screen 511 a desirable arcuate shape (indicated in FIG. 14 by phantom lines) if the nature of the objects or the nature of treatment of the objects is such that the screen should be formed with a convex exposed side. The manner in which the retainer 511*a* is adjustably secured to the corresponding web or rib 311 is not specifically shown in FIGS. 14 and 15. The arrangement may be such that the retainer 511*a* tends to impart to the screen 511 a concavo-convex shape only when the screen 511 is not overlapped by an object 3. Once the screen is overlapped, suction in the openings 211 of the adjacent panels of the corresponding supporting member 111** attracts the objects toward the panel and thereby flattens the screen.

The structure which is shown in FIG. 16 constitutes a slight modification of the structure in FIGS. 14 and 15 in that the cooling element 18 of FIG. 14 is replaced with a heating element or pad **111*a* which is sandwiched between the panels 111' and 111" of the corresponding supporting member 111. The screen 511 overlies the outer side of the panel 111', and the inner side of the panel 111" is adjacent to the corresponding compartment 11A. The reference character 19 denotes a tubular element which is inserted into the holes 211 of the panels 111, 111' and heating element 111*a*. The tubular member 19 allows for more accurate withdrawal of air from the interstices of the screen 511. The outer end of the tubular member 19 is slightly spaced apart from the inner side of the screen 511. The member 19** can be replaced with a tubular member having a larger or smaller flow-restricting passage.

Figure 17:
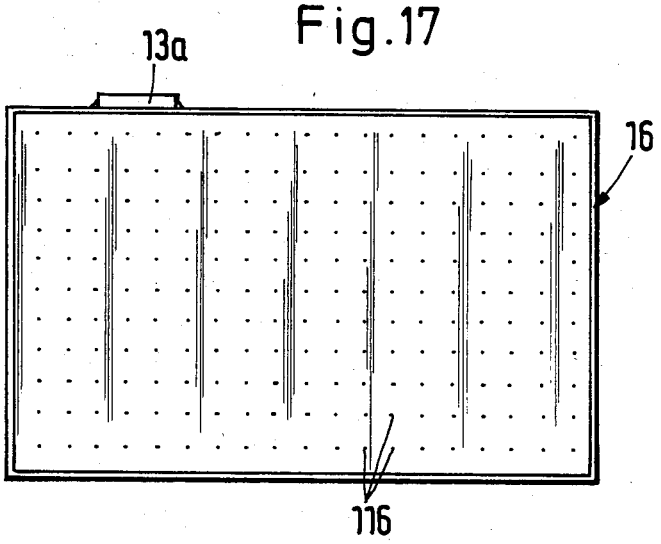
FIG. 17 is a front elevational view of a flat box-shaped blowing nozzle which can be used in the apparatus of FIG. 11.
Figure 18:
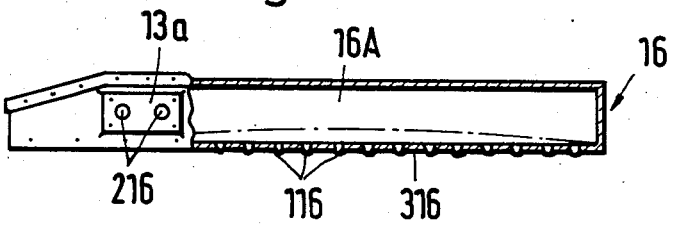
FIG. 18 is a sectional view of the nozzle which is shown in FIG. 17.
Figure 19:
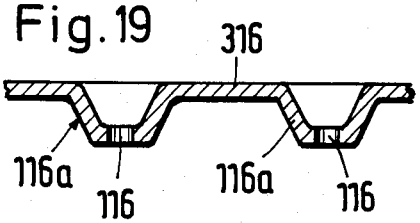
FIG. 19 is an enlarged view of a detail in the nozzle of FIG. 18.

FIGS. 17 to 19 illustrate one of the flat plate-like or box-like nozzles 16 with its orifices 116. The openings 216 are provided in a plate-like outlet **13*a* of the nozzle 16. This outlet is similar to the part 13 of a suction chamber 11 except that it is located in such position that it communicates only with the channel 175 of the valving elements 7. FIG. 19 shows that the nozzle 16 includes a plate-like wall 316 which is adjacent to the corresponding clearance F and is provided with outwardly extending hollow frustoconical portions or protuberances 116*a* each of which has a centrally located orifice 116 serving to discharge a stream of compressed air toward the adjacent screen 511**.

That marginal portion of the nozzle 16 which is nearest to the rotor 10 slopes toward the wall 316 (see the left-hand portion of FIG. 18) so as to ensure that the nozzle 16 can overlie the entire screen 511 of the adjacent supporting member 111. If desired, the wall 316 can have a curvature which is complementary to that of the screen 511 on the adjacent supporting member 111. This ensures that all of the orifices 116 are located at the same distance from the object 3 on the adjacent screen 511. The nozzles 16 and the suction chambers 11 can be made of a metallic material.

The fan 6 is preferably adjustable so as to ensure that the subatmospheric pressure in the compartments 11A of the suction chambers 11 is maintained at a desirable optimum value which may require adjustment if one type of objects is to be followed by another type of objects which require a different treatment. When the supporting members 111 are not overlapped by objects, they permit air to flow into the corresponding compartments 11A at a predetermined rate. In other words, all of the holes 211 in a supporting member 111 are then free to admit air into the corresponding compartment 11A. If some of the holes 211 are overlapped by an object, the non-overlapped holes permit the same quantity of air to flow into the corresponding compartment 11A. In either event, the objects are securely held by suction and, in the apparatus of FIGS. 11 to 19, the objects are further held by streams of compressed air which issue from the orifices 116. As mentioned above, the screens 511 exhibit the advantage that the streams which would otherwise flow directly into the holes 211 of the corresponding supporting members 111 are broken up into large numbers of smaller streams so as to reduce the likelihood of undesirable deformation of a readily flexible object (e.g., a thin plastic foil) on the exposed side of a screen.

The apparatus of FIGS. 11 to 19 exhibits the additional advantage that the streams of compressed air which issue from the orifices 116 can be caused to impinge substantially at right angles to the exposed sides of the adjacent objects 3 in the corresponding clearances F. This enables such streams of compressed air to straighten out those portions of an object which tends to bend or flex away from the adjacent screen 511. In other words, the streams of compressed air perform a desirable flattening or straightening action and ensure that the entire object is held in full contact with the adjacent screen 511. Furthermore, the jets of compressed air issuing from the orifices 116 reduce the saturation pressure of solvents in paints and like substances on the objects in the clearances F. The streams of compressed air also ensure that such solvents are rapidly expelled from the clearances F to allow for rapid completion of the treatment. The utilization of concavo-convex screens 511 is desirable on the ground that such screens are more likely to prevent wrinkling or other deformations of the objects which are held thereon by suction. The curvature of the screens 511 is not pronounced and can be minimal, as long as it can ensure that the objects are less likely to develop wrinkles, folds or similar deformations.

The improved apparatus exhibits the advantage that its space requirements are but a small fraction of the space requirements of heretofore known conventional contact drying or cooling apparatus. This is due to the fact that the rotor 10 can support a substantial number of suction chambers 11 and that the objects 3 can be caused to move all the way to or into close proximity of the external surface of the rotor. The energy requirements of the improved apparatus are also a small fraction of the energy requirements of a conventional apparatus. If the apparatus is designed to cool sheet-like or similar objects, the cooling zone or zones need not be traversed by any transporting means for objects which also contributes to lower energy requirements of the apparatus. Furthermore, the objects are dried or cooled as a result of contact with the adjacent supporting members which ensures an optimum transfer of energy between the supporting members and the objects. The housing 2 also contributes to the energy-saving operation of the apparatus. Such housing can surround the path of orbital movement of the suction chambers 11 from three sides. The suction chambers 11 act in the interior of the housing 2 not unlike the vanes or blades of a turbine wheel and compel a pronounced circulation of air with attendant intensification of the heating or cooling action.

The improved apparatus can be automated to any desired extent. For example, the objects 3 can be fed by hand or by suitable automatic or semiautomatic equipment whose operation can be monitored by photocells or the like. The distance which must be covered by an object in order to complete the drying or cooling operation is but a fraction of the distance which must be covered by objects in conventional apparatus. For example, if an object which is treated in a conventional apparatus must cover a distance of between 8 and 12 meters, the same object can be treated at least as satisfactorily in the improved apparatus by causing it to cover a distance of approximately 120 centimeters. As a rule, the distance which an object must cover in the improved apparatus in order to complete its treatment depends on the nature of treatment, on the nature of the substance or substances which have been applied to the object prior to introduction into the apparatus and on many other parameters. For example, if the objects issue from a screen printing machine and must be cooled or dried, the duration of treatment and the distance to be covered by the objects depend on the consistency of coloring or other matter which was applied in the screen printing machine. Furthermore, the distances which are to be covered by the objects depend on the speed of the rotor 10 as well as on the construction and mode of operation of the drive means 5, i.e., whether the rotor is driven continuously or in stepwise fashion. Stepwise operation is often preferred if the objects are to be fed by hand. If the operation is discontinuous, the objects undergo at least some treatment during the intervals of idleness of the rotor 10, and this must be taken into consideration in calculating the overall distance to be covered by objects prior to their ejection at the station A. The provision of a discrete regulator 20 for each suction chamber 11 allows for individual adjustment of each temperature influencing element **111*a* or 18**.

The objects can be fed to successive supporting members 111 in a manner as shown, for example, in FIG. 4, or at numerous other locations at the exterior of the rotor 10. For example, the objects can be fed to the suction chambers 111 vertically downwardly at the twelve o'clock position of the rotor 10 in FIG. 4 so that each object covers an angle of approximately 225 degrees from the apex of the rotor to the ejecting station A. The suction chambers 11 ensure adequate and reliable retention of objects irrespective of whether they are fed at the three o'clock position, at the one-thirty o'clock position or at the twelve o'clock position of FIG. 4. The jets of compressed air which issue from the holes 211 at the ejecting station A can lift the freshly treated objects off the respective supporting members 11 before the objects leave the apparatus in the direction of the arrow C shown in FIG. 1. The arrangement is preferably such that, if the objects constitute sheets carrying printed or other matter which is applied thereto in a screen printing machine or the like, those sides which carry printed matter face upwardly during transfer into the receptacle 8 or onto the conveyor 81. Ejection in a downward direction, especially after an angular movement through a relatively small angle, is not as desirable because this does not allow for predictable gravitational sliding movement of objects from the corresponding supporting members and into a receptacle or onto a conveyor. Each supporting member 111 can simultaneously carry two or more smaller objects or an entire array of objects, such as several components of electronic devices and the like.

The apparatus can be used with the same degree of efficiency and predictability for the treatment of long or shorter series of discrete objects. Such objects can include those which are treated in screen printing machines as well as numerous other commodities which resemble or constitute sheets, plates, webs, panels or the like. Small parts can be inserted by hand or by robots without departing from the spirit of the invention. The ledges 411 allow for accurate positioning of objects on the corresponding supporting members 111 as well as for accurate positioning of groups of objects. Other types of abutments, stops or differently configurated locating means for objects can be used with equal or similar advantage. Accurate positioning of discrete objects on the supporting members 111 can be further facilitated by the utilization of masking tapes 30 or the like because the operator who places the objects onto the supporting members 111 can readily orient each object in an optimum position so that the object overlies the non-masked part of the respective supporting member. The utilization or non-use of screens 511' depends on the nature of treatment and on the nature of workpieces. As mentioned before, the screens reduce the likelihood of deformation of readily flexible objects under the action of suction in the adjacent ends of the openings 211. The absence of screens 511 further promotes rapid drying or cooling of objects because each object can move into direct contact with the outer panel of the corresponding supporting member 111. If the apparatus is designed for treatment of one and the same type of objects, the panels 111' can constitute the heating or cooling elements which come into direct contact with the objects. This results in further shortening of treating times.

The duration of treatment depends on the nature of the objects and on the speed of the rotor 10. For example, the rotor can be driven to complete twenty revolutions per minute and each object can be treated for an interval of between three to five seconds. Certain objects may require longer-lasting treatment, for example, up to approximately eight seconds. If the rotor is driven at twenty revolutions per minute, this necessitates a retention of the objects during travel of the rotor through an angle which exceeds 360 degrees. In such apparatus, the objects are preferably (but not necessarily) placed onto the supporting members 111 by hand.

The rotor 10 will normally be driven at a higher speed if the apparatus comprises automatic or semiautomatic object feeding means. The number of suction chambers 11 can be increased or reduced, depending on the contemplated capacity of the apparatus. For example, the number of suction chambers can be doubled to sixteen or reduced to four.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for contact drying and/or cooling of sheet- or plate-like and other relatively thin objects, comprising a rotor; drive means for said rotor; and a plurality of suction chambers provided on and extending outwardly of said rotor, each of said chambers having a substantially plate-like object supporting member, and each of said supporting members having an outer surface provided with a plurality of suction openings arranged to attract objects to and hold objects against the exterior of the respective supporting member.

2. The apparatus of claim 1, wherein said drive means is arranged to rotate said rotor about a predetermined axis and in a predetermined direction, each of said supporting members being located in a plane which is substantially parallel with or includes said, axis, and each of said outer surfaces facing forwardly as considered in said direction.

3. The apparatus of claim 1, further comprising a suction generating device and means for connecting said suction chambers to said device during a predetermined portion of each revolution of said rotor.

4. Apparatus for contact drying and/or cooling of sheet- or plate-like and other relatively thin objects, comprising a rotor; drive means for continuously rotating said rotor about a predetermined axis; and a plurality of suction chambers provided on and extending outwardly from said rotor, each of said chambers having a substantially plate-like foraminous object supporting member.

5. Apparatus for contact drying and/or cooling of sheet- or plate-like and other relatively thin objects, comprising a rotor; drive means for intermittently rotating said rotor about a predetermined axis; and a plurality of suction chambers provided on and extending outwardly from said rotor, each of said chambers having a substantially plate-like foraminous object supporting member.

6. Apparatus for contact drying and/or cooling of sheet- or plate-like and other relatively thin objects, comprising a rotor; drive means for said rotor; a plurality of suction chambers provided on and extending outwardly from said rotor, each of said chambers having a substantially plate-like foraminous object supporting member and an outlet, and said chambers being arranged to orbit about the axis of rotation of said rotor along an endless path; a suction generating device; and means for connecting said suction chambers to said device during a predetermined portion of each revolution of said rotor, said connecting means including a stationary valving element having a channel adjacent to at least one predetermined portion of said path and connected to said suction generating device, and said outlets being in communication with said channel during travel of the respective chambers along said portion of said path.

7. The apparatus of claim 6, further comprising an object-supplying station adjacent to said portion of said path.

8. The apparatus of claim, 7, wherein said object supporting members are at least substantially horizontal while the respective chambers are adjacent to said station.

9. Apparatus for contact drying and/or cooling of sheet- or plate-like and other relatively thin objects, comprising a rotor; drive means for said rotor; a plurality of suction chambers provided on and extending outwardly from said rotor, each of said chambers having a substantially plate-like foraminous object supporting member, and said chambers being arranged to orbit about the axis of rotation of said rotor along an endless path; a suction generating device; means for connecting said suction chambers to said device during a predetermined portion of each revolution of said rotor; and means for accepting dried or cooled objects from said supporting members, said accepting means being adjacent to a predetermined portion of said path, and each chamber which is located in said portion of said path being disconnected from said suction generating device to allow for ready separation of objects therefrom.

10. The apparatus of claim 9 wherein said accepting means comprises a receptacle for objects.

11. The apparatus of claim 9, wherein said accepting means comprises a conveyor.

12. The apparatus of claim 9, further comprising a source of compressed air and means for coupling said source with the suction chambers in said portion of said path.

13. The apparatus of claim 12, wherein said source includes said suction generating device and said coupling means includes a portion of said connecting means.

14. Apparatus for contact drying and/or cooling of sheet- or plate-like and other relatively thin objects, comprising a hollow rotor; drive means for said rotor; a plurality of suction chambers provided on and extending outwardly from said rotor, each of said chambers having a substantially plate-like foraminous object supporting member, and each of said chambers including means for influencing the temperature of objects on the respective supporting member; an energy source; and means for connecting said energy source with said influencing means, said connecting means including a portion in the interior of said rotor.

15. The apparatus of claim 14, wherein each of said influencing means includes a heating element and each of said supporting members includes two panels, said heating elements being sandwiched between the panels of the respective supporting members.

16. The apparatus of claim 15, wherein one panel of each of said pairs of panels has an exposed object-contacting side and each of said chambers has a compartment adjacent to the other panel of the respective pair of panels, said supporting members having openings each extending from the exposed side of the respective one panel toward and communicating with the respective compartment.

17. The apparatus of claim 15, said energy source being a source of electrical energy; and wherein said connecting means includes at least one carbon brush connected to said source, at least one slip ring provided on said rotor and contacting said brush, and conductor means connecting said slip ring with said heating elements.

18. The apparatus of claim 17, wherein said conductor means includes a portion in the interior of said rotor, said conductor means further comprising terminals provided on said chambers at the exterior of said rotor.

19. Apparatus for contact drying and/or cooling of sheet- or plate-like and other relatively thin objects, comprising a rotor; bearing means defining for said rotor a substantially horizontal axis; drive means for said rotor; and a plurality of suction chambers provided on and extending outwardly from said rotor, each of said chambers having a substantially plate-like foraminous object supporting member, and said supporting members being located in planes which are at least substantially parallel to or include said axis.

20. Apparatus for contact drying and/or cooling of sheet- or plate-like and other relatively thin objects, comprising a rotor; drive means for said rotor; a plurality of suction chambers provided on and extending outwardly from said rotor, each of said chambers having a substantially plate-like foraminous object supporting member and an outlet, and said chambers further having compartments and being arranged to orbit about the axis of rotation of said rotor along an endless path; a suction generating device; and means for connecting said suction generating device with said outlets, said connecting means including a manifold rotatable with said rotor and communicating with said compartments, and a stationary valving element having a channel in communication with said suction generating device and communicating with said manifold to connect said compartments with said device by way of said valving element during at least one predetermined portion of each revolution of said rotor.

21. The apparatus of claim 20, comprising a source of compressed air and means for coupling said source with the compartments of successive chambers by way of said valving element and said manifold while said compartments are sealed from said suction generating device.

22. The apparatus of claim 21, wherein said valving element has a groove which communicates with said source and said manifold has at least one first port for each compartment which communicates with said channel during said predetermined portion of each revolution of said rotor and at least one second port for each compartment which communicates with said groove during another predetermined portion of each revolution of said rotor.

23. The apparatus of claim 22; wherein said channel and said groove have arcuate shapes and have centers of curvature on the axis of said rotor.

24. The apparatus of claim 22, wherein said connecting means further comprises a disc-shaped friction clutch element interposed between said valving element and said manifold and having apertures in register with the ports of said manifold, said clutch element being arranged to rotate with said manifold.

25. The apparatus of claim 22 wherein said connecting means further comprises at least one conduit connecting said suction generating device with said channel and at least one additional conduit connecting said source with said groove.

26. The apparatus of claim 20, wherein said connecting means further comprises at least one flexible conduit connecting said valving element with said suction generating device.

27. The apparatus of claim 20, further comprising means for biasing said valving element toward said manifold.

28. The apparatus of claim 20, wherein said connecting means further comprises a friction clutch element interposed between said manifold and said valving element and being rotatable with said rotor, said clutch element having apertures arranged to communicate with said channel during said predetermined portion of each revolution of said rotor, and said valving element being in direct contact with said clutch element.

29. The apparatus of claim 1, wherein said chambers are arranged to orbit about the axis of said rotor along an endless path; and further comprising means for supplying objects to the supporting members of successive chambers in a predetermined portion of said path.

30. The apparatus of claim 1, further comprising means for coupling said chambers to said rotor.

31. The apparatus of claim 1, wherein said chambers have means for locating objects on the respective supporting members.

32. Apparatus for contact drying and/or cooling of sheet- or plate-like and other relatively thin objects having predetermined outlines, comprising a rotor; drive means for said rotor; and a plurality of suction chambers provided on and extending outwardly from said rotor, each of said chambers having a substantially plate-like foraminous object supporting member, and said supporting members having profiles which are complementary to the outlines of the objects.

33. Apparatus for contact drying and/or cooling of sheet- or plate-like and other relatively thin objects, comprising a rotor; drive means for said rotor; a plurality of suction chambers provided on and extending outwardly from said rotor, each of said chambers having a substantially plate-like foraminous object supporting member, and said chambers being arranged to orbit about the axis of rotation of said rotor along a predetermined path; an object supplying station adjacent to a predetermined portion of said path; and an emergency actuating device for said drive means in the region of said station.

34. Apparatus for contact drying and/or cooling of sheet- or plate-like and other relatively thin objects, comprising a rotor; drive means for said rotor including a prime mover, and a power train between said prime mover and said rotor, said power train including friction clutch means; and a plurality of suction chambers provided on and extending outwardly from said rotor, each of said chambers having a substantially plate-like foraminous object supporting member.

35. Apparatus for contact drying and/or cooling of sheet- or plate-like and other relatively thin objects, comprising a rotor; drive means for said rotor; and a plurality of suction chambers provided on and extending outwardly from said rotor, each of said chambers having a substantially plate-like foraminous object supporting member, and said supporting members being arranged to receive objects from a screen printing machine.

36. Apparatus for contact drying and/or cooling of sheet- or plate-like and other relatively thin objects, comprising a rotor; drive means for said rotor; and a plurality of suction chambers provided on and extending outwardly from said rotor, each of said chambers constituting a substantially flat box-like structure and having a substantially plate-like foraminous object supporting member, and each of said supporting members including an object-contacting screen.

37. The apparatus of claim 36, further comprising means for tensioning the screens of said supporting members.

38. The apparatus of claim 36, wherein each of said supporting members further comprises an uneven back support for the respective screen.

39. Apparatus for contact drying and/or cooling of sheet- or plate-like and other relatively thin objects, comprising a rotor; drive means for said rotor; a plurality of suction chambers provided on and extending outwardly from said rotor, each of said chambers having a substantially plate-like foraminous object supporting member; and means for blowing compressed air against the objects on said supporting members.

40. The apparstus of claim 39, wherein said blowing means comprises nozzles alternating with said chambers and having orifices arranged to direct jets of compressed air against the objects on the adjacent supporting members.

41. The apparatus of claim 40, wherein said nozzles and the adjacent supporting members define clearances for the placing of objects onto and for removal of objects from the respective supporting members.

42. The apparatus of claim 41, further comprising a source of compressed air and means for connecting said source with said nozzles.

43. The apparatus of claim 42, wherein said connecting means comprises a stationary valving element adjacent to said nozzles and having an arcuate channel in communication with said source.

44. Apparatus for contact drying and/or cooling of sheet- or plate-like and other relatively thin objects, comprising a rotor; drive means for said rotor; a plurality of suction chambers provided on and extending outwardly from said rotor, each of said chambers having a substantially plate-like formanious object supporting member; heating elements for the objects on said supporting members; and discrete regulators for said heating elements.

45. Apparatus for contact drying and/or cooling of sheet- or plate-like and other relatively thin objects, comprising a rotor; drive means for said rotor; a plurality of suction chambers provided on and extending outwardly from said rotor, each of said chambers having a substantially plate-like foraminous object supporting member, and said chambers being arranged to orbit about the axis of rotation of said rotor along an endless path; and a housing surrounding a portion of said path.

46. The apparatus of claim 45, wherein said chambers extend substantially radially of and outwardly from said rotor.

47. Apparatus for contact drying and/or cooling of sheet- or plate-like and other relatively thin objects, comprising a rotor; drive means for said rotor; a plurality of suction chambers provided on and extending substantially radially of and outwardly from said rotor, each of said chambers having a substantially plate-like foraminous object supporting member which includes an object-contacting screen; nozzles provided on and rotatable with said rotor and alternating with said chambers; a source of compressed air; and means for connecting said nozzles with said source, said nozzles having orifices arranged to direct jets of compressed air toward the objects on the adjacent screens.

48. The apparatus of claim 47, wherein said rotor is arranged to rotate about a predetermined axis and in a predetermined direction and said screens have exposed sides facing forwardly as considered in said direction, the dimensions of said nozzles at least approximating the dimensions of the adjacent supporting members.

49. Apparatus for contact drying of discrete printed sheets issuing from a screen printing machine, comprising a rotor having a substantially horizontal axis; drive means arranged to rotate said rotor about said axis in a predetermined direction; a plurality of suction chambers provided on and extending outwardly of said rotor such that said rotor and said suction chambers have a star-like configuration, each of said chambers having a substantially plate-like object supporting member which faces forwardly as considered in said direction and includes a heating element, and each of said supporting members having a forwardly facing outer surface provided with a plurality of suction openings arranged to attract sheets to and hold sheets against the exterior of the respective supporting member, said chambers being arranged to orbit about said axis along an endless path; first connecting means for connecting said chambers with a source of suction, said first connecting means being designed such that suction in said chambers is interrupted in a predetermined portion of said path; second connecting means for connecting said heating elements with a source of energy; and a supply station adjacent to a predetermined location of said path for supplying discrete printed sheets issuing from a screen printing machine to said supporting members.

* * * * *